United States Patent [19]

Andersson

[11] Patent Number: 4,999,892

[45] Date of Patent: Mar. 19, 1991

[54] DEVICE AT MACHINES FOR CONTINUOUS SEPARATION OF A STRIP FROM A HOSE-FORMED MATERIAL WEB

[75] Inventor: Sture Andersson, Ljungskile, Sweden

[73] Assignee: Svegea of Sweden AB, Sweden

[21] Appl. No.: 438,464

[22] PCT Filed: Jun. 22, 1988

[86] PCT No.: PCT/SE88/00346

§ 371 Date: Dec. 21, 1989

§ 102(e) Date: Dec. 21, 1989

[87] PCT Pub. No.: WO88/10181

PCT Pub. Date: Dec. 29, 1988

[30] Foreign Application Priority Data

Jun. 24, 1987 [SE] Sweden ..... 8702609

[51] Int. Cl.[5] ..... B26D 3/16

[52] U.S. Cl. ..... 29/2.1; 29/2.15; 29/2.22; 83/175

[58] Field of Search ..... 83/411.3, 175; 29/2.1, 29/2.15, 2.22, 2.19

[56] References Cited

U.S. PATENT DOCUMENTS 3,776,077 12/1973 Letsche ..... 83/175
4,047,272 9/1977 King et al. ..... 29/2.19
4,480,365 11/1984 Sumoto ..... 29/2.1

FOREIGN PATENT DOCUMENTS 2932006 2/1981 Fed. Rep. of Germany ..... 83/175
3001814 7/1981 Fed. Rep. of Germany ..... 83/175
2063520 7/1971 France ..... 29/2.1

*Primary Examiner*—Douglas D. Watts
*Assistant Examiner*—John M. Husar
*Attorney, Agent, or Firm*—Ostrolenk, Faber, Gerb & Soffen

[57] ABSTRACT

A device at machines for continuous separation of at least one strip (49) from a hose-formed material web (14). The device (19) incorporates at least two lead rollers (16, 18) at least one (18) of which being tiltable relative to the other, thus that the end portion of the material web, which is thread on the guide rollers at rotation of the guide rollers, is imparted a continuous, axial feeding motion towards a severing device (50). The tiltable lead roller (18) is supported at one free end of an axially displaceable and in different displacement positions arrestable rod (20), the free end of which is pivotably to a limited extent on one hand about a shaft (31) mainly parallel with the rod and on the other hand about an axis (44) mainly perpendicular to the rod. This (20) is equipped with means (33, 43) for arresting its free end in different angular positions.

7 Claims, 3 Drawing Sheets

DEVICE AT MACHINES FOR CONTINUOUS SEPARATION OF A STRIP FROM A HOSE-FORMED MATERIAL WEB

The present invention refers to a device at machines for continuous separation of a strip from a hose-formed material web, whereby the device incorporates at least two lead rollers at least one of which is tiltable relative to the other. Thus the end portion of the material web which is threaded on the guide rollers at rotation of the guide rollers is imparted a continuous, axial feeding motion towards a severing device.

BACKGROUND OF THE INVENTION

The initial material for production of above-mentioned strips is preferably a tubular knitted, hose-formed knitted web, from which is continuously severed one or more strips, whereby the knitted tube is rotated at the same time as it is fed axially against a cutting member, which severs the strip in helical form.

The inner circumference of the knitted tube may vary from one tubular knitting machine to another, but it may also differ from one manufacturer to another. It therefore is necessary to be able to adapt the mutual position of the lead rollers to the inner circumference of the material hose, which has hitherto been obtained in that the tiltable lead roller is suspended in a ball joint. With such a design it however is not possible to obtain a position finding in a three-dimensional system of coordinates. This means that the machine, at adjustment to a material web of a different diameter, must be completely re-aligned, which means that one meter or more of the material web is used for the very alignment not to mention a big waste of time. There is also known a rather complicated rod system, incorporating double rods in the X-Y coordinates, and a particular adjustment device for the adjustment of the lead roller or lead rollers in the Z-coordinate. This known device is both complicated and expensive to manufacture and it requires a big space. It is furthermore difficult to make the adjustments.

PURPOSE AND MOST ESSENTIAL FEATURES OF THE INVENTION

The purpose of the present invention is to provide a device of the type mentioned in the introductory part, which has a simple design and therefore inexpensive to produce, which with some simple had grips allows a change of the mutual position of the lead rollers for adjustment to the circumference of other material webs. The device furthermore shall be designed thus that it is easy to find an earlier determined X, Y and Z position, thus that there is no unnecessary alignment work. These tasks have been solved in that the tiltable lead roller is supported at one free end of an axially displaceable and in different displacement positions arrestable rod, that the free end of the rod is pivotable to a limited extent, on one hand about a shaft mainly parallel with the rod, and on the other hand about an axis mainly perpendicular to the rod, and that the rod is equipped with means for arresting its free end in different angular positions.

DESCRIPTION OF THE DRAWINGS

The invention hereinafter will be further described with reference to the drawings, which show an embodiment.

DESCRIPTION OF EMBODIMENT

Figure 1:
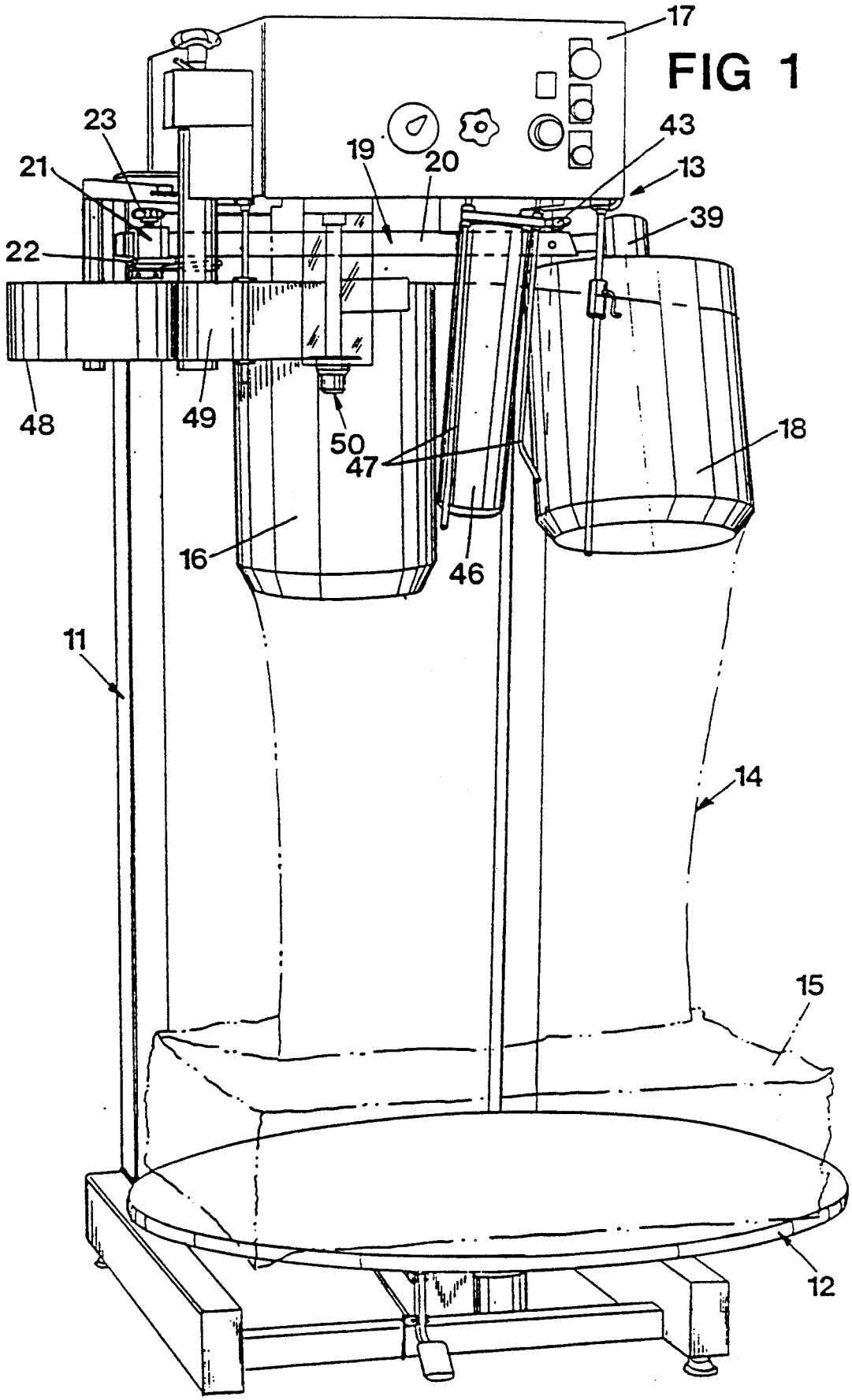
FIG. 1 shows in perspective a machine for continuous separation of a strip from a hose-formed material web, which machine is equipped with the device according to the invention.
Figure 2:
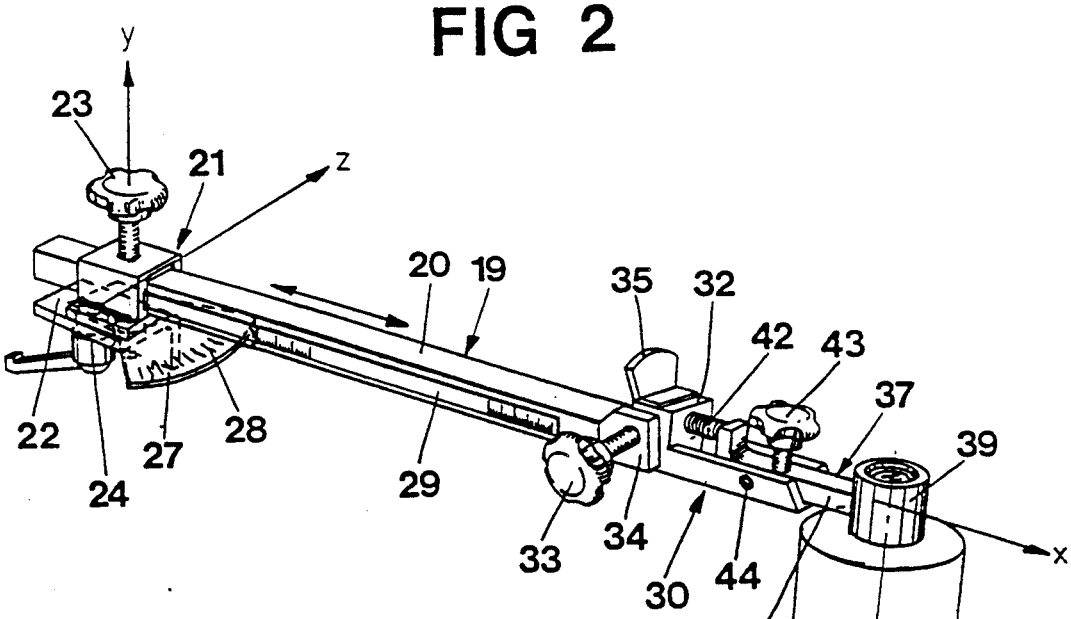
FIG. 2 shows also in perspective the device according to the invention, dismounted from the stand.
Figure 5:
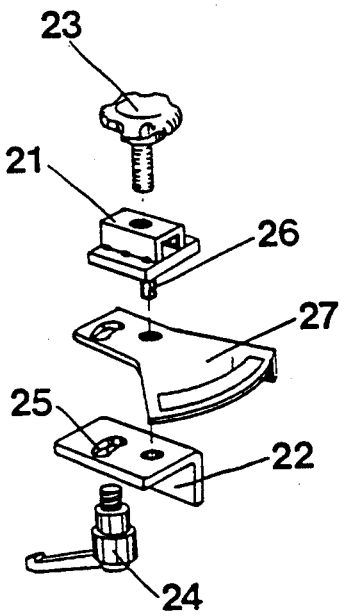
FIG. 5 shows in perspective an exploded view of the rearmost retainer of the device.
Figure 5:
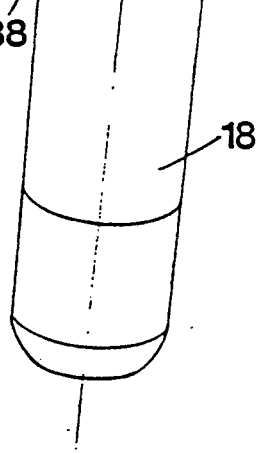
Figure 3:
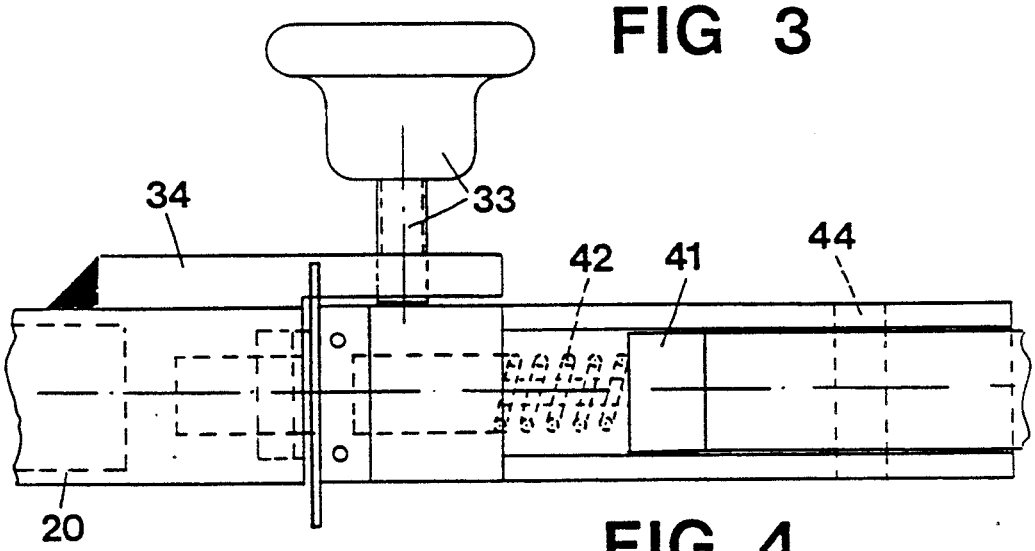
FIG. 3 shows in bigger scale a side view of the front end of the device.
Figure 4:
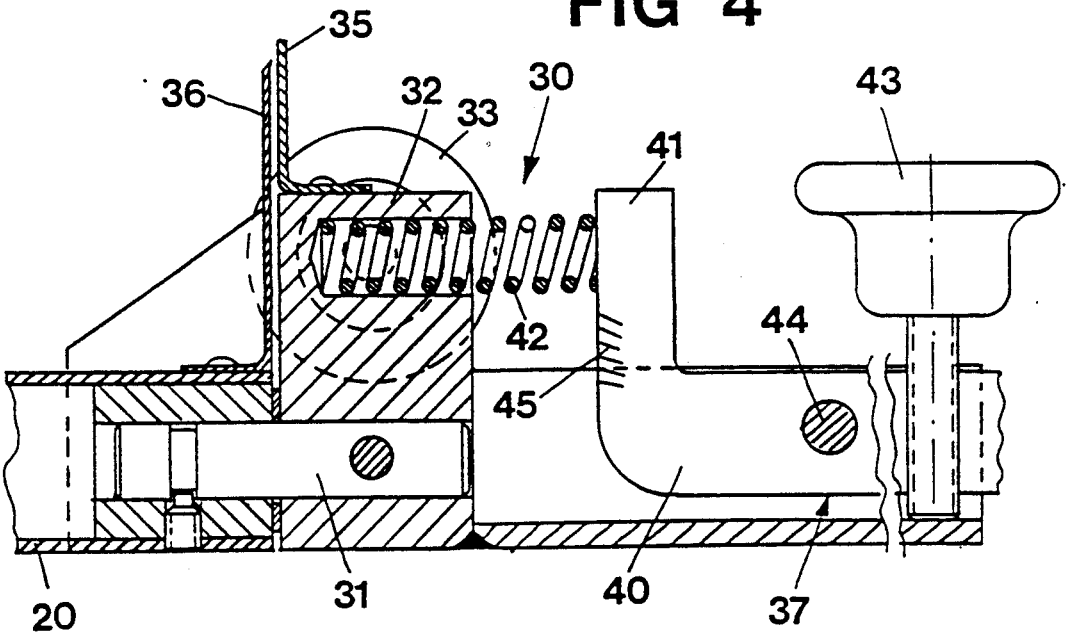
FIG. 4 is a section along line IV-IV in FIG. 3.

The severing machine consists according to FIG. 1 of a stand 11, which at its lower part supports a rotatable disc 12 and at the upper part a feeding and cutting device 13. Reference numeral 14 designates the tubular hose-web, which is intimated in dash-and-dot lines, and which in the embodiment shown is piled, i.e. is folded into a pack 15, which is arranged upon the rotatable disc 12.

The feeding and cutting device incorporates a rotatable, stationary lead roller 16, the rotational axis of which is vertically disposed and which is rotated by a not further shown motor situated behind the control panel 17. The second lead roller 18 is supported by the device 19 according to the invention, which incorporates a rod 20, which at its rear end is supported in a retainer 21, which is fitted to a bracket 22 at the stand 11. The rod 20 may be arrested in different pulled out or pushed n positions by means of a check screw 23. By means of a handle 24 on the lower side of the bracket 22, in which is provided an arc-shaped groove 25, it is possible to revolve the rod 20 with the retainer 21 about a vertical shaft journal 26. Between the bracket 22 and the retainer 21 is provided a plate 27 equipped with a scale 28, along which the angular position of the rod 20 can be red. On one longitudinal side of the rod is also provided a scale 29, by means of which the pushed in or pulled out position of the rod can be indicated.

At the free front end of the rod 20 is provided a head 30, which is pivotable about a shaft 31 arranged substantially parallel to the rod 20. The head 30 is equipped with an eccentrically arranged pivoting arm 32 for cooperation with a set screw 33, which is supported by a bracket 34 fitted to the rod 20. In order to indicate the angular position of the head 30 relative to the rod 20 there is provided upon the pivoting arm 32 a scale 35 and on the rod 20 a dial 36.

At the head 30 in the extension of the rod 20 there is pivotably supported a double-armed lever 37, at one lever arm 38 of which is fitted a retainer 39 for the lead roller 18, whereas its second lever arm 40 with a bent portion 41 cooperates with a compression spring 42 provided in a bore in the pivoting arm 32. By means of a set screw 43 provided at some distance from the pivot axis 44 of the lever 37 it is possible to arrest the obliquity of the lever 37 and thereby of the lead roller 18 against the action of the compression spring 42. A scale 45 at the upwardly bent lever arm end 41 facilitates the setting of the lever 37.

By means of the device 19 according to the invention it is thus possible to adjust the mutual distance between the lead rollers 16 and 18 to every occuring hose diameter, by pulling out the rod 20 more or less. The inclined position of the movable lead roller 18 is adapted to the rotational speed of the driven lead roller 16 thus, that an appropriate feed speed is obtained for the hose-formed knitted web 14. The tilted lead roller 18 thus is pivotable about the axis 44 in a X-Y plane in a system of coordinates, about the shaft 31 in the Y-Z plane and about the shaft journal 26 of the retainer 21 about the X-Z plane, which means that the lead roller has e free, but limited movability, whereby all angular and pivot positions are indicated thus that a position once set and aligned can be found again swiftly.

Beside the two lead rollers 16 and 18 are provided one further lead roller 46, lead pins 47 and a winding-up roller 48 for the belt or strip 49 severed from the material web 14. The severing device of the machine is designated 50.

The invention is not limited to the embodiment shown but a plurality of variants are possible within the scope of the claims.

What is claimed:

1. A device for continuously separating at least one strip from a material web in hose form, the device comprising:

at least two lead rollers extending generally in the same direction and being generally next to each other, a first one of the rollers being tiltable relative to a second one of the rollers, at least one of the first and second rollers being rotatable as the web is fed past the rollers, and a severing device generally supported near the rollers for severing the web;

an axially displaceable rod supported at the device and axially displaceable with respect to the second roller, and means located between the first tiltable roller and the second roller for halting the axial displacement of the rod;

the tiltable first roller being supported on the axially displaceable rod for being displaced axially with the axially displaceable rod; a shaft supported on and extending parallel to the axially displaceable rod, the first roller being supported on the shaft on the rod for being pivotable about the shaft around a first axis defined by the shaft; first means on the rod for arresting motion of the first roller on the rod in different angular positions around the first axis at the shaft;

a second axis on the axially displaceable rod generally perpendicular to the rod, the first roller being positioned at a distance along the length of the rod from the second axis, whereby the first roller may be pivoted around the second axis to different tilt orientations; second means for arresting motion of the first roller around the second axis;

a retainer for the rod spaced away from both the tiltable first lead roller and from the second axis, the retainer being pivotable about a third axis perpendicular to the first and second axes, and such pivoting around the third axis being in a displacement plane defined by movement of the rod about the third axis whereby the rod may be pivoted to different angular positions around the third axis for swinging the first lead roller around the third axis; and a third means for arresting the rod in a selected position around the third axis.

2. The device of claim 1, wherein the axially displaceable rod has a free end on which the first tiltable lead roller is supported and has an opposite, retained portion which is spaced from the free end where the rod is held by the retainer;

the shaft at the rod being disposed on the rod at a location spaced from the free end of the rod so that the free end of the rod is a separate part of the rod and is pivotable about the shaft;

the second pivot axis perpendicular to the rod is located on the free end of the rod;

the first arresting means being for limiting pivoting of the free end of the rod about the shaft and the first axis; the second arresting means being for establishing the angular tilt of the free end of the rod around the second axis.

3. The device of claim 2, further comprising an indicator scale at the third arresting means for indicating the angular position of the displaceable rod around the third axis.

4. The device of claim 3, further comprising an indicator scale at the second arresting means for indicating the pivot angle of the free end of the rod around the shaft.

5. The device of claim 1, further comprising an indicator scale at the second arresting means for indicating the pivot angle of the free end of the rod around the shaft.

6. The device of claim 1, further comprising an indicator scale at the third arresting means for indicating the angular position of the displaceable rod around the third axis.

7. The device of claim 2, wherein the free end of the rod comprises a support head which is rotatable about the shaft and an eccentric pivoting arm on the support head, the second arresting means comprises a set screw at the rod tightenable against the pivoting arm for holding the pivoting arm and the support head in a set angular position;

the free end of the rod further including a lever thereon, a second retainer on the lever and spaced from the second axis for holding the first tiltable lead roller on the lever;

the second axis at the free end of the rod joins the lever with the rotatable head so that the lever is pivotable with respect to the rotatable head at the second axis;

the lever extending from the first roller past the second axis to a surface on the lever, a compression spring between the pivoting arm of the rotatable head and the surface on the lever for normally urging the lever to pivot in one direction around the second axis thereby to move the first roller to pivot in one direction, and the second arresting means acting on the lever for holding the lever in a pivot position relative to the rotatable head and opposing the bias of the spring against the lever.

* * * * *